US008256166B2

(12) United States Patent
Lonnberg

(10) Patent No.: US 8,256,166 B2
(45) Date of Patent: Sep. 4, 2012

(54) OPENABLE ROOF OR WALL

(75) Inventor: Benth Lonnberg, Helsingborg (SE)

(73) Assignee: Benth & Mirja Lonnberg AB, Helsingborg (SE)

( * ) Notice: Subject to any disclaimer, the term of this patent is extended or adjusted under 35 U.S.C. 154(b) by 122 days.

(21) Appl. No.: 12/864,303

(22) PCT Filed: Jan. 23, 2009

(86) PCT No.: PCT/SE2009/000023

§ 371 (c)(1),
(2), (4) Date: Oct. 28, 2010

(87) PCT Pub. No.: WO2009/093957

PCT Pub. Date: Jul. 30, 2009

(65) Prior Publication Data

US 2011/0036021 A1 Feb. 17, 2011

(30) Foreign Application Priority Data

Jan. 25, 2008 (SE) ..... 0800180

(51) Int. Cl.
*E04B 1/346* (2006.01)
*E04B 7/16* (2006.01)

(52) U.S. Cl. ..... 52/66; 52/68

(58) Field of Classification Search ..... 52/64, 66, 52/67, 68, 72, 238.1; 277/603, 628, 637, 277/641, 650, 654
See application file for complete search history.

(56) References Cited

U.S. PATENT DOCUMENTS

| | | | | |
|---|---|---|---|---|
| 4,616,451 | A * | 10/1986 | Glick | 52/66 |
| 5,829,204 | A * | 11/1998 | Lonnberg | 52/66 |
| 6,595,525 | B2 * | 7/2003 | Schmidt | 277/630 |
| 2004/0135323 | A1 * | 7/2004 | Salameh | 277/628 |

FOREIGN PATENT DOCUMENTS

| | | | |
|---|---|---|---|
| DE | 4039115 | A1 | 6/1992 |
| DE | 4407479 | A1 | 9/1995 |
| EP | 0497315 | A1 | 8/1992 |
| FR | 2668537 | A1 | 4/1992 |

OTHER PUBLICATIONS

International Search Report: PCT/SE2009/000023.

* cited by examiner

*Primary Examiner* — Brian Glessner
*Assistant Examiner* — Adriana Figueroa
(74) *Attorney, Agent, or Firm* — Ladas & Parry LLP

(57) ABSTRACT

The invention relates to an openable roof or openable wall, comprising at least one section (1) extending along a longitudinal axis, each section comprising a plurality of panels (2*a*, 2) overlapping in pairs along said longitudinal axis, whose longitudinal edge portions (39) are movably received in guide rails (4) for the purpose of opening and closing. Each panel (2, 2*a*) has, on its second transverse edge portion (38), a first (21) and a second (27) sealing strip, which between them define a gap (28). This gap (28) cooperates with a bottom surface (31) of the inner longitudinal surfaces (14) of the guide rails (4) to form a draining channel (29) along said bottom surface and away from said first sealing strip (21).

17 Claims, 7 Drawing Sheets

OPENABLE ROOF OR WALL

TECHNICAL FIELD

The present invention relates to an openable roof or an openable wall for use in premises where it is desirable to have completely or partially openable sections. Such a roof or wall may be used, for example, in public premises such as restaurants, pool areas or shopping malls, but also in more private places such as glazed balconies and atriums. The invention is not limited, however, to these exemplifying applications.

BACKGROUND ART

An openable roof or an openable wall usually consists of two or more panels, which are displaceable relative to each other along guide rails between an open and a closed state. Because the panels are suspended from guide rails there are a number of junctions and joints through which air, moisture and dirt, such as dust and pollen, are able to penetrate. As a rule the moisture and dirt are caused by wind and weather, but may also be a consequence of maintenance activities such as window cleaning. Moisture may also accumulate in the form of a condensate, which is due to the natural moisture content of the atmosphere. No matter how the moisture penetrates into junctions and joints, it causes the formation of condensate and discoloration, which affects visibility and the overall visual appearance as well as the material in itself in the form of corrosion and aging. Moreover, the moisture binds dirt, which necessitates regular maintenance.

A particular area associated with the risk of air and dirt penetrating due to wind and weather is the zone of overlap between two panels. This zone forms an air pocket which is closed along three edge portions of the two overlapping panels, but which opens onto the surroundings along a fourth edge portion, and more specifically into the open air on the outside of the roof/wall. Under windy conditions water/snow or dirt may be blown into the air pocket, which is similar to a wind catcher. By using various seals the air and the moisture/dirt are prevented from penetrating further between the two panels. A sealing system of this kind is disclosed in U.S. Pat. No. 5,829,204, in which the air pocket is delimited along three edges by seals arranged between two overlapping roofing panels.

Yet, penetration cannot be prevented altogether, since some leakage will always occur due to the capillary action between the individual seal and the surface against which it seals. Furthermore, leakage occurs through the gap that is inevitably formed between the individual seal and the surface against which it seals as the wind blows into the air pocket. This is because the wind causes a cyclic deflection of the upper, outermost panel relative to the lower, inner panel in the form of a lifting motion transversely of the latitudinal direction of the panels. The lifting motion causes a gap to form in the sealing surface between the two panels, through which air, moisture and dirt may enter, thereby penetrating further into the guide rails. Once the moisture is inside the guide rails there is no natural way for it to escape. To eliminate the risk of this type of wind-related deflection and moisture penetration, the extent of the panels in the transverse direction is usually limited and the surface instead divided into several sections. This means that more panels and more guide rails are required, which makes the roof or wall more expensive and less aesthetically appealing. Furthermore, it will be appreciated that by providing tighter surfaces gains in the form of lower heating costs for the premises can be achieved.

OBJECTS OF THE PRESENT INVENTION

The object of the present invention is to provide an openable roof or openable wall which has an improved sealing effect with respect to air and moisture penetration as compared with openable roofs or walls according to prior art.

Another object is to provide a sealing effect such as to allow increased panel widths and, thus, use of fewer panels and suspension profiles, respectively, for a certain surface.

A further object is that the concept should provide a sealing effect which is sufficiently improved to allow a reduction of the regular maintenance activities.

SUMMARY OF THE INVENTION

To achieve at least one of the above objects and other non-stated objects which will appear from the following description, the present invention relates to an openable roof or openable wall, comprising at least one section extending along a longitudinal axis, each section comprising a plurality of panels overlapping in pairs along said longitudinal axis, each of which comprises two opposite, mutually parallel longitudinal edge portions, which extend parallel to said longitudinal axis, and a first and a second transverse edge portion, which extend transversely of said longitudinal axis, two suspension profiles extending in parallel along said longitudinal axis and comprising guide rails for supporting said panels, the longitudinal edge portions being movably received in guide rails to enable opening and closing of the section by relative displacement of the panels along the longitudinal axis of the guide rails, the first transverse edge portion of a superjacent panel of a pair of panels overlapping, in the closed state of the section, the second transverse edge portion of a subjacent panel of said pair, and each panel on the second transverse edge portion comprising a first sealing strip, which in its longitudinal direction comprises three sections, a first and a second section of which each encloses, in a direction transversely of said longitudinal axis, a longitudinal edge portion of the panel and a third section of which extends between the first and the second section on the upper side of the panel. The openable roof or wall is characterised in that each panel, on said transverse edge portion, further comprises a second sealing strip, which in its longitudinal direction comprises three sections, a first and a second section of which each at least partly encloses, at least in a direction transversely of said longitudinal axis, a longitudinal edge portion on the upper side of the panel and a third section of which extends between the first and the second section on the upper side of the panel, the first sealing strip being arranged closest to an outer edge of the second transverse edge portion and the first and second sealing strip defining between them a gap, which gap cooperates with a bottom surface of the inner longitudinal surfaces of the guide rails to form a drainage channel along said bottom surface in the longitudinal direction of the respective guide rail away from said first sealing strip.

It has been found that an openable roof or wall of this design has an excellent sealing effect with respect to weather-related penetration of air, moisture and dirt. It has also been found that it has an excellent capacity for draining off the moisture that does after all manage to penetrate, no matter whether the moisture is in its liquid phase or its vapour phase. Tests have shown the sealing effect to be so good that the width of the panels could be increased without affecting the sealing effect, which allows increased section widths and, thus, the use of fewer panels and suspension profiles, respectively, for a certain surface. The invention thus enables a more aesthetically appealing and energy-saving openable roof or openable wall. The invention also enables reduced heating costs.

The openable roof or wall according to the invention can be said to have four sealing zones, which all serve as an obstacle to an incoming flow of air and airborne moisture. The first zone consists of the air pocket that is formed between each pair of overlapping panels. The penetrating air must initially have sufficient kinetic energy, i.e. speed, to penetrate into this air pocket and reach the second sealing strip, which forms a second zone. Once there, the air still needs sufficient kinetic energy to be able to penetrate through the second sealing strip. On its way through the sealing strip, large particles such as dust, pollen and sand are filtered out. The degree of filtration and also of energy reduction depends on the density of the sealing strip. Most of the moisture that appears in liquid form, if any, is unable to penetrate due to the density of the sealing strip. Moisture in vapour form, however, is able to penetrate by way of diffusion. Depending on a possible wind-related deflection air/moisture/dirt may, of course, also be able to pass through the opening which is formed, in this case, between the sealing strip and its contact surface. The air/moisture/dirt that, despite the above obstacles, is able to penetrate through the second sealing strip will enter a third zone, which consists of the gap between the first and second sealing strips. In the third zone more kinetic energy is lost due to the sudden increase in volume to which the air is subjected in the gap. By now the air has lost so much kinetic energy that it is simply not capable of penetrating through the fourth zone, which consists of the first sealing strip. This means that, under normal conditions, the first sealing strip will provide an almost absolute protection against air leaking into the premises. Instead the air will spread in the gap. And so will the moisture, no matter whether it is in liquid form or vapour form. Due to the reduced kinetic energy of the air, any dirt will fall to the bottom of the gap and remain there.

Because the first and second segments of these two sealing strips enclose, completely and at least partly, respectively, the longitudinal edge portions of the panel, the gap has the same extension as these two sealing strips. The gap thus extends from the upper side of the panel, around the longitudinal edge portions and further down on the underside of the panel. As a result, the air and, in particular, the moisture will travel through the gap and down towards the underside of the panel, and more specifically onto the bottom surface that is formed on the inner longitudinal surface of the guide rail. Moisture in liquid form, if any, will be able to flow along the guide rail in the drainage channel formed between said bottom surface and the underside of the first and second sections, respectively, of the second sealing strip. Moisture in vapour form, if any, will be able to either escape with the air through the drainage channel or penetrate by way of diffusion through the second sealing strip and its first and second sections, respectively, and further out into the drainage channel. A seen in the direction of the lower, transverse edge portion of the panel, the drainage channel may open into the open air. As a result the moisture, whether in liquid form or vapour form, may escape through the drainage channel.

In view of the above, it will be appreciated that it takes extreme wind loads to overcome the sealing effect of the first and second sealing strips, thereby enabling air, moisture and dirt to penetrate between the panels and into their guide rails. The air and moisture that do after all penetrate is allowed to escape, in a controlled manner, through the gap and the drainage channel.

Dirt in particulate form is filtered out very efficiently by having it pass through two zones, on one hand the air pocket between the two overlapping panels and, on the other, the second sealing strip, before it is able to penetrate into inaccessible spaces such as the gap, between the panels and on the inside of the guide rails.

In the case of an openable roof, such a roof is normally mounted at a certain angle to a horizontal plane, which means that the suspension profiles with their guide rails will be mounted at the same angle. This means that any moisture/dirt that penetrates into the guide rails through gravitation will be conveyed downwards through the drainage channel. Drainage may also take place through the scraping motion occurring between the guide rails and the first and second sections, respectively, of the first and second sealing strips as the panel is displaced relative to the guide rails for the purpose of opening or closing.

Said gap may comprise a recessed groove. This causes further dissipation of the energy of the air that is able to penetrate into the gap through the space between the third segment of the second seal and the surface against which this strip is adapted to seal, i.e. the lower panel. The penetrating air needs to have a certain quantity of energy, i.e. speed, to be able to first penetrate the first zone between two overlapping panels and then penetrate also the second zone, which consists of the second sealing strip. The remaining quantity of energy is significantly reduced as it enters the third zone, i.e. the recessed groove, since this groove represents a greater volume.

Each panel may further comprise third sealing strips on its two longitudinal edge portions on the upper side of the panel, which third sealing strips are arranged to extend from the second to the first transverse edge portion, and wherein said third sealing strips, in the second transverse edge portion, are in contact with the second sealing strip for forming a continuous joint with the same. In this way air, moisture and dirt are prevented from penetrating between the guide rail and the panel transversely of the longitudinal extension of the guide rail.

Moreover, each panel may comprise fourth sealing strips on its two longitudinal edge portions on the underside of the panel, which fourth sealing strips are arranged to extend from the second to the first transverse edge portion, and wherein said fourth sealing strips, in the second transverse edge portion are in contact with the first sealing strip for forming a continuous joint with the same.

Accordingly, on the underside of the panel the fourth sealing strip cuts off the gap between the first and second sealing strips. This means that the air and moisture that have accumulated in the gap and pass through it down to the underside of panel will be prevented by this sealing strip from continuing in the longitudinal direction of the gap. Instead the air and moisture will travel downwards towards the first and second sections of the second sealing strip on the underside of the panel and continue through the drainage channel.

Each panel may further comprise fourth sealing strips on its two longitudinal edge portions on the underside of the panel, which fourth sealing strips are arranged to extend from the second to the first transverse edge portion, and wherein said fourth sealing strips, in the second transverse edge portion, are in contact with the first and the second sealing strips for forming a continuous joint therewith. The main purpose of these sealing strips is to prevent air, moisture and dirt from penetrating between the guide rail and the panel transversely of the longitudinal direction of the guide rail.

The first sealing strip may form a fluid tight seal against the inner longitudinal surface of said guide rail and against the adjacent panel of said panels overlapping in pairs, respectively. By this is meant a sealing effect between the sealing strip and its contact surface which air and moisture, with dimensioning parameters for normal wind loads, are unable to overcome. The first sealing strip may be made of a non diffusion tight material. Examples of this type of material are a heavily compressed brush-type seal, a brush-type seal comprising a film which extends in the direction of the bristles or an extruded, flexible strip of, for instance, rubber, plastic or silicone. It will be appreciated that the sealing capacity is dependent not only on the choice of material but also on parameters such as the degree of compression and the width of the sealing strip. It is obvious to the person skilled in the art to identify a sealing strip that is suitable for this purpose.

The second sealing strip may form a non fluid tight seal against the inner longitudinal surface of said guide rail and against the adjacent panel of said panels overlapping in pairs, respectively. By this is meant a sealing effect such that air and moisture, while meeting with resistance, are able to pass either through the sealing strip or between the sealing strip and the surface against which it seals. The second sealing strip may be made of a non diffusion tight material. Examples of this type of material are a brush-type seal or a flocked sealing strip. It will be appreciated that the sealing capacity is dependent not only on the choice of material but also on parameters such as the degree of compression and the width of the sealing strip. It is obvious to the person skilled in the art to identify a sealing strip that is suitable for this purpose.

The third and fourth sealing strips may form a fluid tight seal against the inner longitudinal surface of said guide rail. By this is meant a sealing effect between the third and fourth sealing strips and their contact surface such that air and moisture, with parameters dimensioned for normal wind loads, are unable to penetrate. The third and fourth sealing strips may be made of a diffusion tight material. Examples of this type of material are a heavily compressed brush-type seal, a brush-type seal comprising a film which extends in the direction of the bristles or an extruded, flexible strip of, for instance, rubber, plastic or silicone. It will be appreciated that the sealing capacity is dependent not only on the choice of material but also on parameters such as the degree of compression and the width of the sealing strip. It is obvious to the person skilled in the art to identify a sealing strip that is suitable for this purpose.

The first and the second section, respectively, of the first sealing strip may each form a sliding element adapted to cooperate with the inner longitudinal surface of the associated guide rail during displacement of the panels relative to the guide rails. Owing to the flexibility of the sealing strip the sliding surfaces fill up the space between the panel and the inner longitudinal surface of the guide rail.

The second transverse edge portion may comprise grooves for receiving said first and second sealing strips. The grooves provide what can be described as a pre-forming of the shape of the sealing strips, since the wall portions of said grooves will limit the lateral extent of the sealing strips when they abut against the surface against which they are intended to seal. This provides a better sealing effect. The grooves also help to prevent the sealing strips, which are typically attached by gluing, from becoming slightly offset due to the shear force to which they are subjected as the panel is moved along the guide rail during use.

The suspension profiles may comprise a number of guide rails corresponding to the number of panels of which the section is composed. Advantageously, each such suspension profile may be in the form of an extruded profile including a number of guide rails, one for each panel that is to make up the section. The suspension profile may also be designed in other ways, which will be obvious to the skilled person.

The first and the second section, respectively, of the sealing strip may form an end seal for the guide rails at the second transverse edge portion of the panel. The end seal prevents air, moisture and dirt from penetrating into the guide rail from that direction.

The panel may be a roofing panel or a wall panel.

BRIEF DESCRIPTION OF THE DRAWINGS

The invention will now be described in more detail by way of example and with reference to the accompanying drawings, which illustrate a currently preferred embodiment.

TECHNICAL DESCRIPTION

The following description is based on a substantially horizontally oriented openable surface in the form of a roof, but it will be appreciated that the concept is applicable whether it is an openable roof or an openable wall, i.e. regardless of the spatial orientation of the surface.

Some of the terms used in the description will be explained below.

By "longitudinal axis" is meant the geometric axis along which the panels are movable for the purpose of opening and closing.

By "transverse" is meant an orientation perpendicularly of the longitudinal axis as seen in the plane of extension of the panel.

By "upper side" is meant the side of the panel which in normal use is intended to be facing away from the premises. Correspondingly, by "underside" is meant the side of the panel which in normal use is intended to be facing in towards the premises.

By "longitudinal edge portions" are meant the surface portions of the panel that are received in the guide rails. In the case of a U-shaped guide rail and a rectangular panel of a certain thickness, the longitudinal edge portions thus consist on one hand of the two surface portions located closest to the edges of the upper and underside, respectively, of the panel and, on the other, of the side edges extending there between.

By "transverse edge portions" are meant the upper and lower edge portions interconnecting the longitudinal edge portions.

By "at least partly enclose an edge portion" is meant that the sealing strip and its first and second sections should be arranged on the surface portions of at least the two longitudinal edge portions on the upper side of the panel, and possibly also be arranged to extend down over the side edges or even over the surface portions of the two longitudinal edge portions on the underside of the panel.

Figure 1:
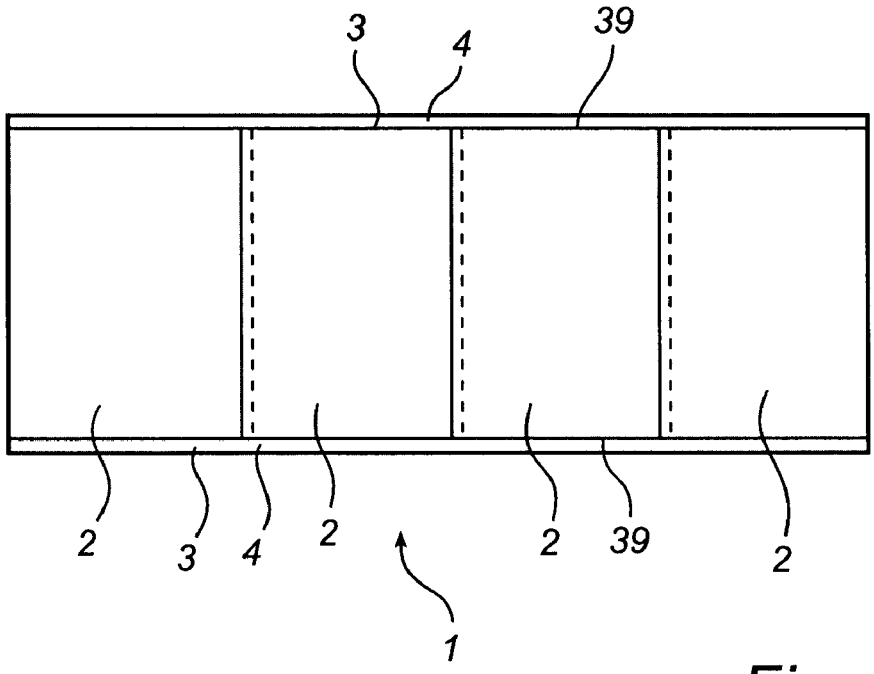
FIG. 1 is a schematic view of a section of openable panels.

With reference now to FIG. 1, a section 1 of an embodiment of an openable roof or openable wall according to the present invention is illustrated highly schematically. To obtain the desired surface a plurality of sections may be mounted next to each other or alongside each other.

The illustrated section 1 has four panels 2, which are mounted in two mutually parallel suspension profiles 3 for forming a substantially horizontal surface. The suspension profiles 3 comprise guide rails 4 for supporting the panels by the longitudinal edge portions 39 of the panels being movably received in the guide rails such that the panels can be moved between the open and closed state of the section. The number of guide rails 4 in the suspension profile 3 normally corresponds to the number of panels of which the section is composed.

Figure 2:
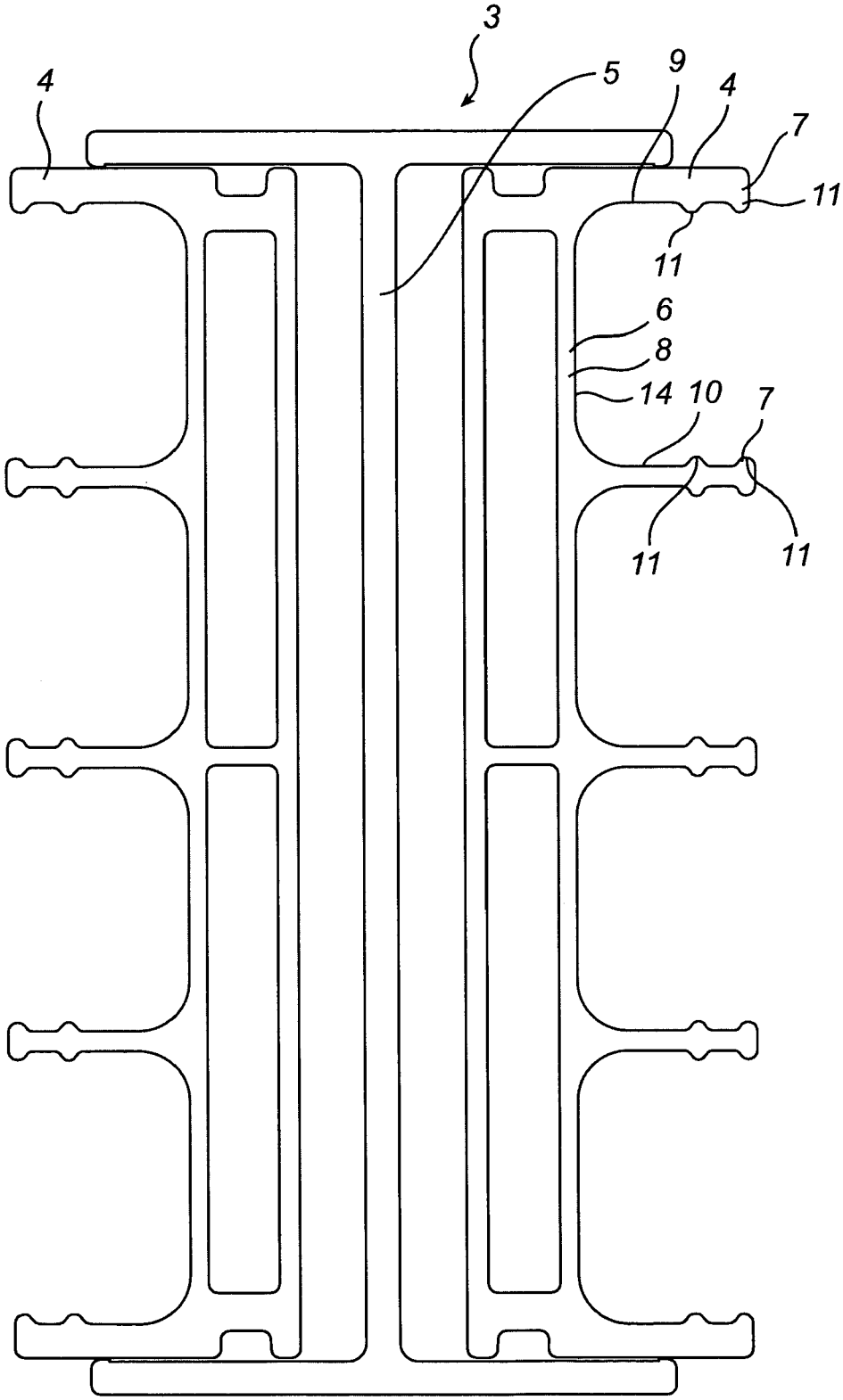
FIG. 2 is a schematic cross-sectional view of a suspension profile and its guide rails.

The suspension profile 3 may be designed in various ways, one embodiment of which in the form of an extruded profile is shown in FIG. 2. Suitable materials are plastic, composite or light metal. The suspension profile 3 may have different shapes depending on whether it is intended for mounting on a wall/roof/floor or between two sections 1. In the case where it is intended for mounting against a wall/roof/floor, it will have guide rails 4 on one side only. If, however, it is intended for mounting between two sections, it will have guide rails 4 on both sides of a vertical partition 5, as shown in FIG. 2. The illustrated suspension profile 3 is intended to be used for a section containing four panels, which means that it has four guide rails 4 on each side of the partition 5.

In the embodiment shown, each guide rail 4 has a cross section in the shape of a lying U, where the web 6 of the inner longitudinal surface 14 of the profile forms an inner vertical guide surface 8 and where the two legs 7 form respectively an upper 9 and a lower 10 guide surface. The upper 9 and the lower 10 guide surface have bosses 11 which extend along the longitudinal axis of the guide rail. These bosses 11 are adapted both to guide the panel and to cooperate with the sealing strips, which will be described below as third and fourth sealing strips.

In the case of roofs, the suspension profiles are usually mounted inclined to the horizontal plane to allow precipitation and dirt to be drained off.

Figure 4:
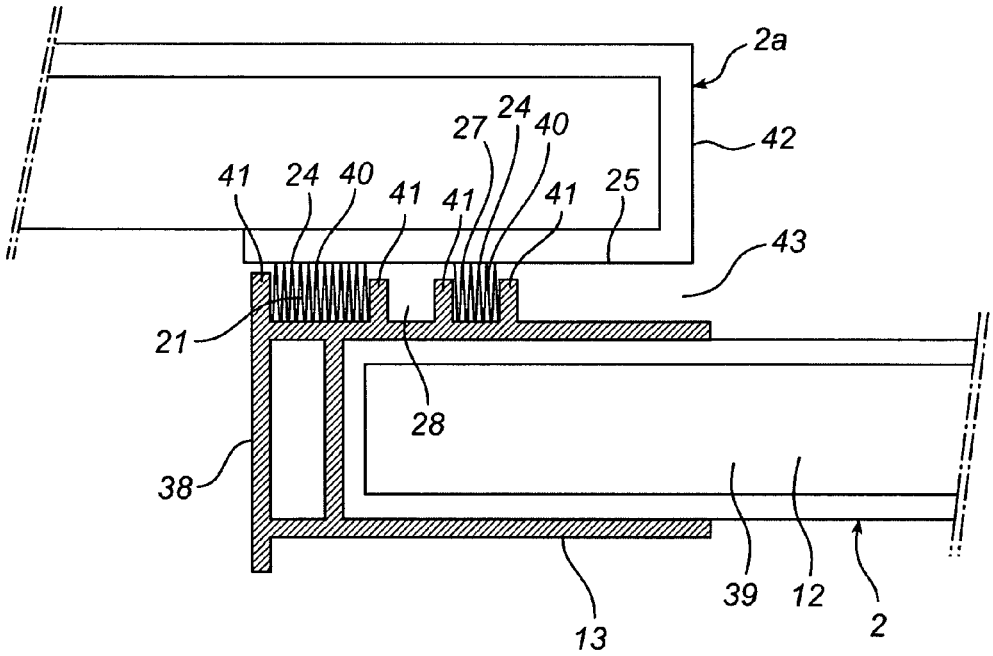
FIG. 4 is a schematic cross-sectional view through the first transverse edge portion and illustrates the cooperation of the first and second sealing strips with a superjacent panel.

With reference to FIG. 4, an embodiment of a panel 2 in the form of a window pane 12 mounted in a circumferential frame 13 is shown. The frame 13 may, for example, be composed of extruded plastic, composite or light metal profiles. The frame 13 forms, wholly or partially, the longitudinal and transverse edge portions, respectively, of the panel. Alternatively, the edge portions may be formed by the pane itself instead of by a separate frame.

Depending on the application, it will be appreciated that, instead of a transparent pane, the panel may be provided with a non-transparent or partially transparent surface.

Figure 3A:
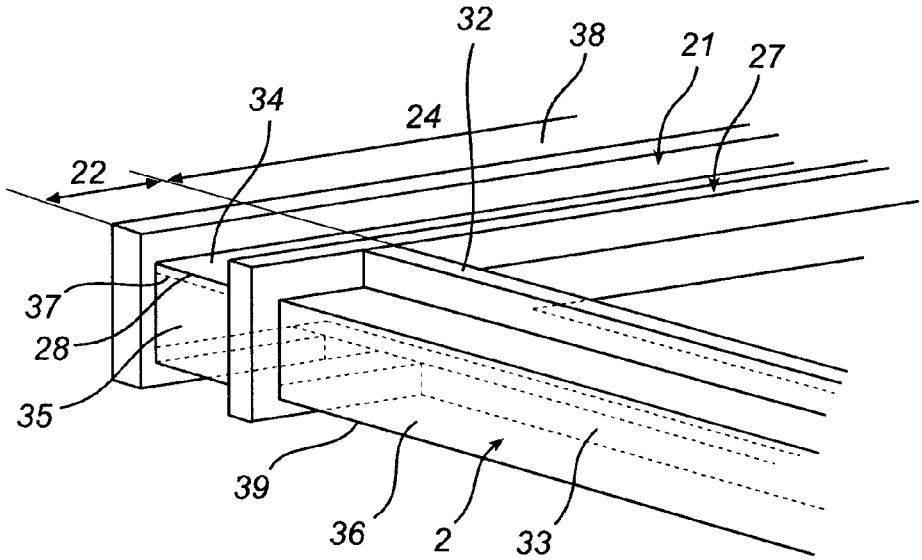
FIGS. 3*a*-3*c* illustrate schematically the extension of the first, second, third and fourth sealing strips at the upper transverse edge portion of the panel.
Figure 3B:
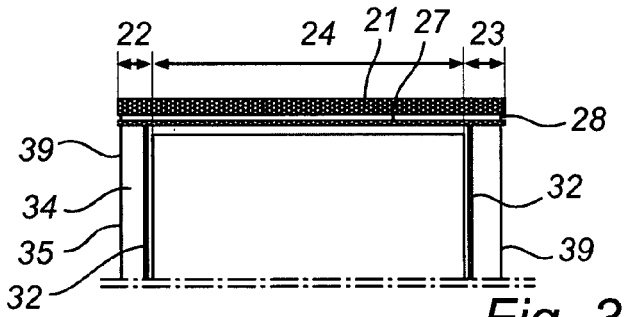
Figure 3C:
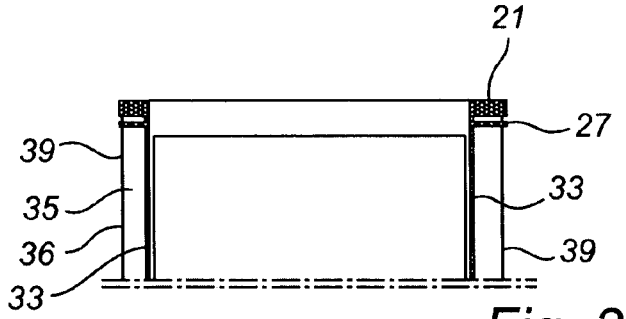

With reference now to FIGS. 3*a*-3*c*, the first transverse edge portion 38 of a lower panel of a pair of two overlapping panels is illustrated schematically as seen in perspective (FIG. 3*a*), from above (FIG. 3*b*and from below (FIG. 3*c*). FIG. 3*b* discloses a top view of the upper portion of the panel. FIG. 3*c* discloses a view from below of the upper portion of the panel.

At the edge of the transverse edge portion 38, the panel 2 has a first sealing strip 21. The sealing strip can be divided into three sections, a first 22 and a second 23 section of which enclose the longitudinal edge portions 39 of the panel, i.e. they extend over the surface portion of the longitudinal edge portions of the upper side 34 of the panel, down over the vertical side edges 35 and further over the surface portions of the longitudinal edge portions of the underside 36 of the panel. On the upper side 34 of the panel, the third 24 section extends between the first 22 and the second 23 section for forming a continuous sealing strip.

Figure 5:
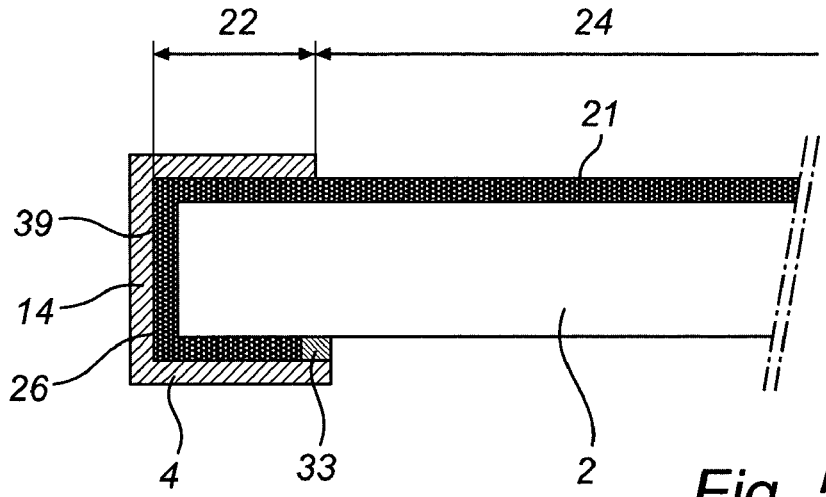
FIG. 5 is a schematic cross-sectional view through the guide rail and illustrates the cooperation of the first sealing strip with the inner longitudinal surface of the guide rail.

With reference now to FIGS. 4 and 5, the first sealing strip 21 forms a fluid tight seal against the inner longitudinal surface 14 of the guide rail 4 and against the adjacent panel 2*a* of said panels overlapping in pairs, respectively. By this is meant a sealing effect between the first sealing strip 21 and its contact surface 25 which air and moisture, with parameters dimensioned for normal wind loads, are unable to overcome. The first sealing strip 21 may be made of a diffusion tight material. Examples of this type of material are a heavily compressed brush-type seal, a brush-type seal comprising a film which extends in the direction of the bristles or an extruded, flexible strip of, for instance, rubber, plastic or silicone. It will be appreciated that the sealing capacity is dependent not only on the choice of material but also on parameters such as the degree of compression and the width of the sealing strip. It is obvious to the person skilled in the art to identify a sealing strip that is suitable for this purpose.

As shown in FIG. 5, the first section 22 of the first sealing strip 21 (and also the second, which is not shown in FIG. 5) fills up the space between the panel 2 and the inner longitudinal surface 14 of the guide rail 4. Thus, the first section 21 and the second 23 section (not shown), respectively, of this sealing strip 21 forms a sliding surface 26 which guides the panel 2 as the latter is displaced relative to the guide rail 4. The two sections further form a kind of end seal for the guide rail, which prevents dirt and moisture from penetrating into the guide rail from that direction.

Referring again to FIGS. 3*a*-3*c*, a second sealing strip 27 extends in parallel with and inside the first sealing strip 21, so as to form a gap 28 between them. Advantageously, the first sealing strip 21 may be wider than the second sealing strip 27. Similarly to the first sealing strip 21, the second sealing strip 27 may be divided into three sections, a first 22 and a second 23 section of which at least partly enclose the longitudinal edge portions 39 of the panel. In the case of complete enclosure, the first 22 and second 23 sections of the second sealing strip 27 have the same extension as the first sealing strip, i.e. they extend over the surface portions of the longitudinal edge portions on the upper side 34 of the panel, down over the vertical side edges 35 and then over the surface portions of the longitudinal edge portions 39 on the underside 36 of the panel. As in FIGS. 3*b* and 3*c*, FIG. 6*b* discloses a top view of the upper portion of the panel and FIG. 6*c* discloses a view from below of the upper portion of the panel. In the case of at least partial enclosure, see FIGS. 6*a*-6*c*, it is sufficient for the first 22 and second 23 section, respectively, to extend over the surface portions of the longitudinal edge portions 39 on the upper side 34 of the panel and up to its longitudinal, vertical side edges 35. On the upper side 34 of the panel the third 24 section extends between the first 22 and the second 23 section for forming a continuous sealing strip.

Figure 7:
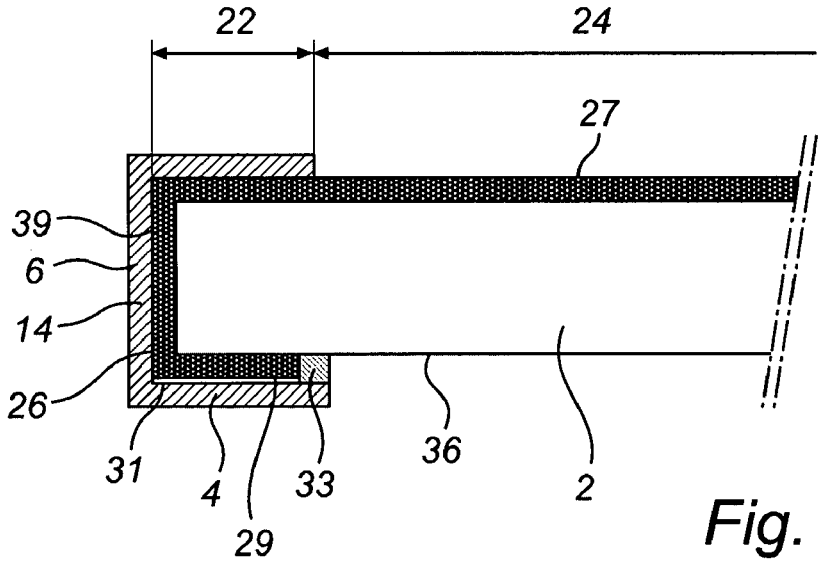
FIG. 7 is a cross-sectional view through a guide rail and illustrates the cooperation of the second sealing strip with the guide rail.
Figure 9:
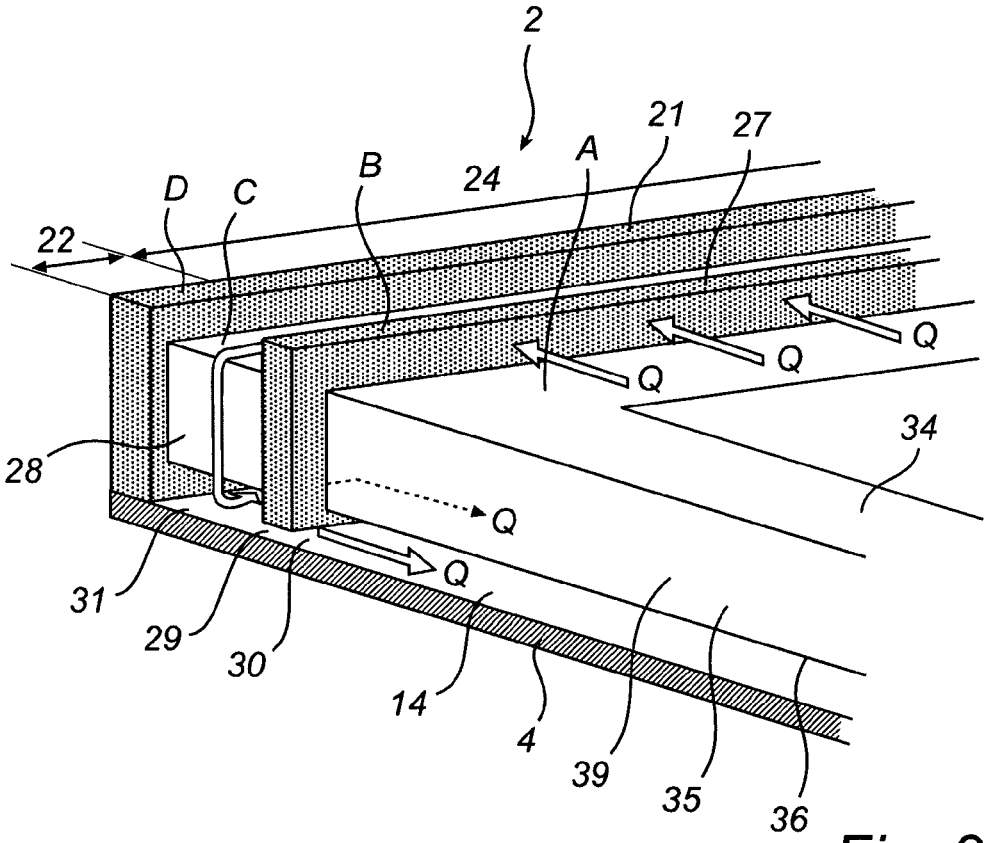
FIGS. 9 and 10 illustrate schematically the path of the air through the seals.

With reference to FIG. 7, a cross section taken through the guide rail 4 is shown schematically for the purpose of illustrating the cooperation of the second sealing strip 27 with the inner longitudinal surface 14 of the guide rail. The first section 22 of the sealing strip 27 encloses the longitudinal edge portion 39, which means that the sealing strip fills up the space between the panel 2 and the guide rail 4. However, the filling up on the underside 36 of the panel is not complete, which means that a drainage channel 29 is formed between the underside of the sealing strip and the bottom surface 31 of the guide rail. With reference to FIG. 9, the drainage channel 29 extends from the gap 28, transversely of the contact surface 30 between the second sealing strip 27 and the bottom surface 31 of the inner longitudinal surface 14 of the guide rail 4 and further out into the guide rail towards the lower, first transverse edge portion 42 of the panel. As seen in the longitudinal direction of the guide rail, see FIG. 7, the drainage channel 29 is defined by the fourth sealing strip 33 (described below), the bottom surface 31 of the inner longitudinal surface 14 of the guide rail 4 and the web 6 of the U-shaped guide rail. In the case of roofs, the fact that the suspension profile is mounted at an angle to a horizontal plane means that draining of moisture occurs naturally.

The drainage channel 29 may be created by incomplete filling up of the space between the underside 36 of the panel and the bottom surface 31 of the guide rail, as shown in FIGS. 7 and 9, or by the sealing strip 27 having a lower degree of compression along the bottom surface 31 of the guide rail 4. In the first case, an unobstructed drainage channel 29 is formed. In the second case, the moisture is able to escape through the structure of the sealing strip, i.e. through its bristles, fibres or porosity. The function of the drainage channel will be described in more detail below.

The first 22 and second 23 sections, respectively, of the second sealing strip 27 may help to form a sliding surface 26 against the guide rail, although this is not their main purpose.

Figure 6A:
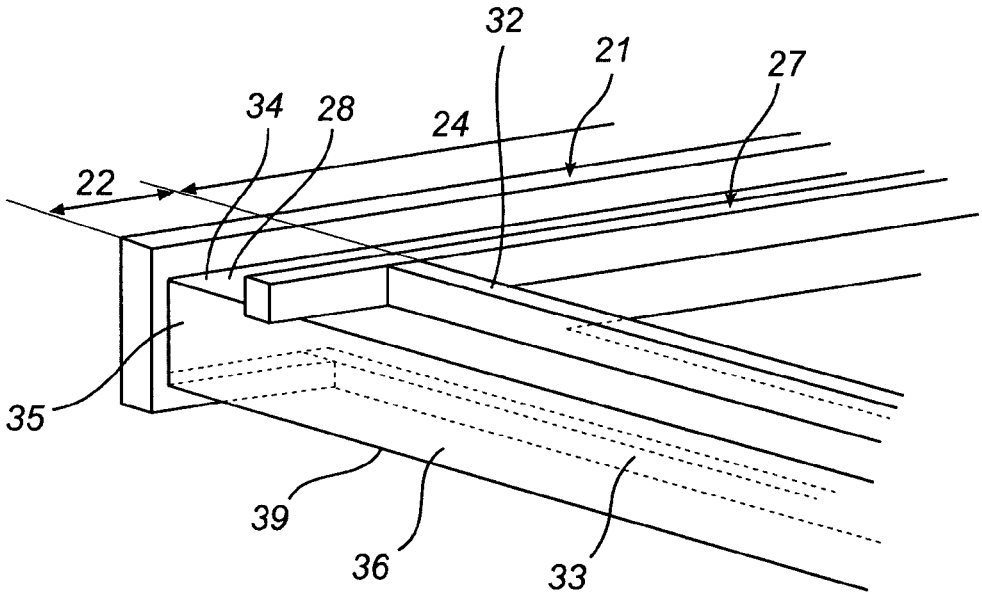
FIGS. 6*a*-6*c* illustrate schematically the extension of the first, second, third and fourth sealing strips at the upper transverse edge portion of the panel for the purpose of indicating the "at least partial enclosure" provided by the second sealing strip.
Figure 6B:
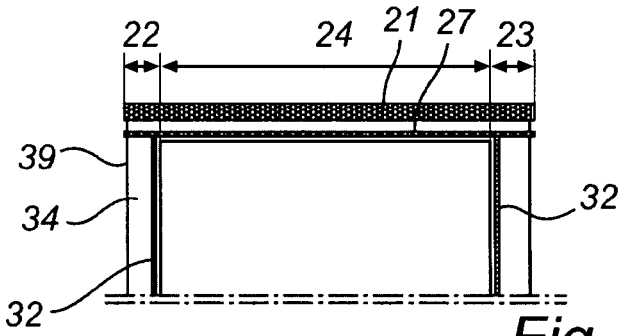
Figure 6C:
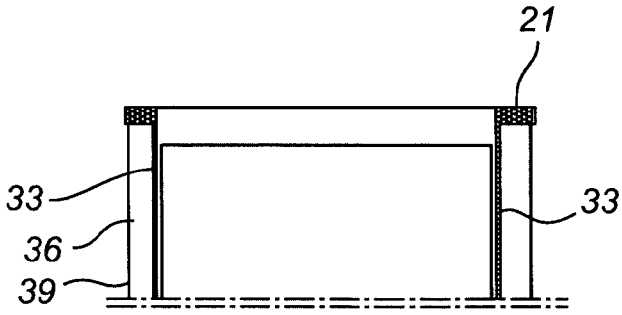

Referring yet again to FIGS. 3*a*-3*c* and to FIGS. 6*a*-6*c*, the gap 28 formed between the first 21 and the second 27 sealing strip will thus extend along the upper side 34 of the panel 2, further down around the longitudinal, vertical side edges 35 and down along the underside 36 of the panel.

The bottom surface of the gap may either be flush with the surface formed by the frame of the panel or be a recessed groove. The bottom surface 37 of the recessed groove is illustrated schematically in FIG. 3*a* in the form of a broken line.

With reference to respectively FIGS. 3*a* and 3*b* and FIGS. 6*a* and 6*b*, the panel 2 further comprises third sealing strips 32 on its upper side 34 and, more specifically, along its two longitudinal edge portions 39. Said third sealing strips 32 extend from the second transverse edge portion 38 of the panel to its first transverse edge portion 42 and are in contact, in the second transverse edge portion, with the second sealing strip 27 for forming a continuous joint with the same.

With reference to FIGS. 3*a* and 3*c* and FIGS. 6*a* and 6*c*, the panel 2 further comprises fourth sealing strips 33 on its upper side 36 and, more specifically, along its two longitudinal edge portions 39. Said fourth sealing strips 33 extend from the second transverse edge portion 38 to the first transverse edge portion 42. Depending on the extent to which the first 22 and second 23 sections of the second sealing strip 27 enclose the longitudinal edge portions 39, the fourth sealing strip 33 may be in contact with both the first 21 and the second 27 sealing strip for forming a continuous joint therewith (FIG. 3*c*), or only with the first sealing strip for forming a continuous joint with the same (FIG. 6*c*).

Figure 8:
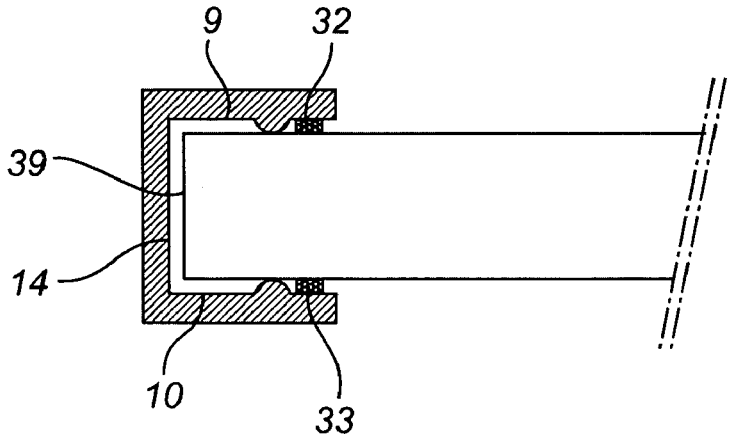
FIG. 8 is a cross-sectional view through the guide rail and illustrates the cooperation of the third and fourth sealing strips with the guide rail.

The purpose of the third 32 and fourth 33 sealing strips is to form a fluid tight seal against the lower 10 and upper 9 surfaces of the inner longitudinal surface 14 of the guide rail 4, see FIG. 8. By this is meant a sealing effect between the third and the fourth sealing strip, respectively, and their contact surfaces in the guide rail such that air and moisture, with dimensioning parameters for normal wind loads, are unable to penetrate. The sealing strips may be made of a diffusion tight material. Examples of this type of material are a heavily compressed brush-type seal, a brush-type seal comprising a film which extends in the direction of the bristles or an extruded, flexible strip of, for instance, rubber, plastic or silicone. It will be appreciated that the sealing capacity is dependent not only on the choice of material but also on parameters such as the degree of compression and the width of the sealing strips. It is obvious to the person skilled in the art to identify a sealing strip that is suitable for this purpose.

With reference to FIG. 4, it is illustrated that the first 21 and second 27 sealing strips may be arranged in grooves 40 running in the second transverse edge portion 38. The grooves, which may be omitted, serve two purposes. First they provide what can be described as a pre-forming of the profile of the sealing strips, since the wall portions 41 of said grooves will limit the lateral extent of the sealing strips when they abut against the surface against which they are intended to seal. This provides a better sealing effect. Second, the grooves also help to prevent the sealing strips, which are typically attached by gluing, from becoming slightly offset due to the shear force to which they are subjected as the panel is moved along the guide rail for the purpose of opening/closing.

With reference to FIG. 4, the panels 2, 2*a* are, in their mounted state, movably inserted in the guide rails of the suspension profile in an overlapping manner. When the two panels forming a pair have been moved to their closed position, the first transverse edge portion 42 of the upper panel 2*a* will overlap the second transverse edge portion 38 of the lower panel 2. The overlap occurs in such a manner that the third sections 24 of the first 21 and the second 27 sealing strip, respectively, of the lower panel 2 will abut and seal against the underside of the first transverse edge portion 42 of the upper panel 2*a*. The overlapping panels define between them an air pocket 43, which is open towards the first transverse edge portion 42 of the upper panel 2*a*.

Figure 10:
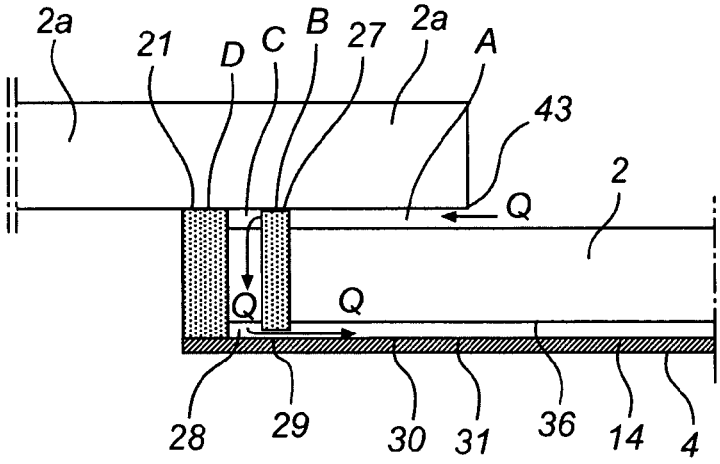

In the following the function of an openable roof or openable wall according to the embodiment described above will be described with reference to FIGS. 9 and 10.

The openable roof/wall according to the invention can be said to have four sealing zones A, B, C and D, which all serve as an obstacle to an incoming flow of air Q and airborne moisture, but also as a protection against penetration of dirt. The first zone A consists of the air pocket 43 that is formed between each pair of overlapping panels 2, 2*a*. The penetrating air Q must initially have sufficient kinetic energy to be able to penetrate into this air pocket 43, thereby reaching the second sealing strip 27, which forms a second zone B. Once there, the air still needs enough kinetic energy to enable it to penetrate through the second sealing strip 27. On its way through the second sealing strip 27, large particles such as dust, pollen and sand are filtered out. The filtering effect is due partly to the density and structure of the second sealing strip 27, partly to its seal against the upper panel 2*a*. The air, moisture and dirt that, despite the above obstacles, are able to penetrate through the second sealing strip 27 will enter a third zone C, which consists of the gap 28 between the first 21 and the second 27 sealing strip. In the third zone C more kinetic energy is lost due to the sudden increase in volume to which the air Q is subjected in the gap 28. By now the air Q has lost so much kinetic energy that it is simply not capable of penetrating through the fourth zone D, which consists of the first sealing strip 21. Instead the air Q will spread in the gap 28. And so will the moisture, no matter whether it is in liquid form or vapour form.

By the first 22 and second 23 sections of the first 21 and second sealing strips 27 at least partially enclosing the longitudinal edge portions 39 of the panel, the gap 28 will have the same extension as these two sealing strips. The gap 28 thus extends from the upper side 34 of the panel 2, around the longitudinal edge portions 39 and further down onto the underside 36 of the panel. As a result, the air Q and, in particular, the moisture will travel through the gap 28 and down towards the underside 36 of the panel and, more specifically, onto the bottom surface 31 that is formed on the inner longitudinal surface 14 of the guide rail 4. Moisture in liquid form, if any, will be able to flow along the guide rail in the drainage channel 29 formed between said bottom surface and the underside of the first and the second section, respectively, of the second sealing strip 27. Moisture in vapour form, if any, will be able to either escape through the drainage channel or pass by way of diffusion through the structure of the second sealing strip and further out through the drainage channel along the guide rail, all depending on the abutment of the second sealing strip against the bottom of the guide rail.

In view of the above, it will be appreciated that it takes extreme wind loads to overcome the sealing effect of the first and second sealing strips, thereby enabling air, moisture and dirt to penetrate between the panels and into their guide rails. The air and moisture that do after all penetrate is allowed to escape, in a controlled manner, through the gap and the drainage channel.

Dirt in particulate form is filtered out very efficiently by having it pass through two zones, on one hand the air gap between two overlapping panels and on the other the second sealing strip, before it is able to penetrate into inaccessible spaces between the panels and the inside of the guide rails.

Since a roof, in normal use, is mounted at a certain angle to a horizontal plane, the suspension profiles with their guide rails will be mounted at the same angle. This means that any moisture/dirt that penetrates into the guide rails will be conveyed downwards through the drainage channel. Drainage does not occur through gravitation only, but also through the scraping motion occurring between the guide rails and the first and second sections, respectively, of the first and second sealing strips as the panel is displaced relative to the guide rail for the purpose of opening or closing.

The above concept is applicable in the same way as for an openable wall with mutually displaceable panels, which in normal use are arranged substantially vertically.

It will be appreciated that in an openable wall according to the present invention any moisture that penetrates into the gap between the first and the second sealing strip will drain off downwards due to gravitation in the direction of the drainage channel formed between the lower longitudinal edge portion and the lowermost guide rail. However, moisture in vapour form will be able to travel upwards along the gap and escape through the drainage channel formed between the upper longitudinal edge portion and the uppermost guide rail.

It will be appreciated that the present invention is not limited to the embodiments described above. Several modifications and variants are conceivable and, therefore, the scope of the present invention is defined solely by the appended claims.

The invention claimed is:

1. An openable roof or openable wall, comprising at least one section extending along a longitudinal axis, each section comprising a plurality of panels overlapping in pairs along said longitudinal axis, each of which comprises two opposite, mutually parallel longitudinal edge portions which extend parallel to said longitudinal axis, and a first and a second transverse edge portion, which extend transversely of said longitudinal axis, two suspension profiles extending in parallel along said longitudinal axis and comprising guide rails for supporting said panels the longitudinal edge portions being movable received in the guide rails to enable opening and closing of the section by relative displacement of the panels along the longitudinal axis of the guide rails, the first transverse edge portion of a superjacent panel of a pair of panels overlapping, in the close state of the section, the second transverse edge portion of a subjacent panel of said pair, and each panel, on the second transverse edge portion, comprising a first sealing strip which in its longitudinal direction comprises three sections, a first and a second section of which each encloses, in a direction transversely of said longitudinal axis, a longitudinal edge portion of the panel and a third section of which extends between the first and the second section on the upper side of the panel, wherein each panel, on said second transverse edge portion, further comprises a second sealing strip, which in its longitudinal direction comprises three sections, a first and a second section of which each at least partly encloses, at least in a direction transversely of said longitudinal axis, a longitudinal edge portion on the upper side of the panel and a third section of which extends between the first and the second section on the upper side of the panel, the first sealing strip being arranged closest to an outer edge of the second transverse edge portion, and the first and the second sealing strip defining between them a gap, which gap cooperates with a bottom surface of the inner longitudinal surfaces of the guide rails to form a drainage channel along said bottom surface in the longitudinal direction of the respective guide rail and away from said first sealing strip.

2. An openable roof or openable wall as claimed in claim 1, wherein said gap comprises a recessed groove.

3. An openable roof or openable wall as claimed in claim 1, wherein each panel on its two longitudinal edge portions on the upper side of the panel, further comprises third sealing strips, which third sealing strips are arranged to extend from the second to the first transverse edge portion, and wherein said third sealing strips, in the second transverse edge portion are in contact with the second sealing strip for forming a continuous joint with the same.

4. An openable roof or openable wall as claimed in claim 3 wherein each panel on its two longitudinal edge portions on the underside of the panel, further comprises fourth sealing strips which fourth sealing strips are arranged to extend from the second to the first transverse edge portion, and wherein the fourth sealing strips, in the second transverse edge portion, are in contact with the first sealing strip for forming a continuous joint with the same.

5. An openable roof or openable wall as claimed in claim 3 wherein each panel, on its two longitudinal edge portions on the underside of the panel, further comprises fourth sealing strips, which fourth sealing strips are arranged to extend from the second to the first transverse edge portion, and wherein the fourth sealing strips, in the second transverse edge portion, are in contact with the first and the second sealing strip for forming a continuous joint therewith.

6. An openable roof or openable wall as claimed in claim 1, wherein said first sealing strip forms a fluid tight seal against the inner longitudinal surface of said guide rail and against the adjacent pane of said panels overlapping in pairs, respectively.

7. An openable roof or openable was claimed in claim 1, wherein said first sealing strip is made of a diffusion tight material.

8. An openable roof or openable wall as claimed in claim 1 wherein said second sealing strip forms a non fluid tight seal against respectively the inner longitudinal surface of said guide rail and against the adjacent panel of said panels overlapping in pairs.

9. An openable roof or openable wall as claimed in claim 1, wherein said second sealing strip is made of a non diffusion tight material.

10. An openable roof or openable wall as claimed in claim 4, wherein said third and fourth sealing strips form a fluid tight seal against the inner longitudinal surface of said guide rail.

11. An openable roof or openable wall as claimed in claim 1, wherein the first and the second section, respectively, of the first sealing strip each forms a sliding element adapted to cooperate with the inner longitudinal surface of the associated guide rail during displacement of the panels relative to the guide rails.

12. An openable roof or openable wall as claimed in claim 1, wherein said second transverse edge portion comprises grooves for receiving said first and second sealing strips.

13. An openable roof or openable wall as claimed in claim 1, wherein said suspension profiles comprise a number of guide rails corresponding to the number of panels of which the section is composed.

14. An openable or openable wall as claimed in claim 1, wherein the first and the second section, respectively, of the first sealing strip form an end seal for the guide rails at the second transverse edge portion of the panel.

15. An openable wall as claimed in claim 1, wherein the panel is a roofing panel.

16. An openable or openable wall as claimed in claim 1, wherein the panel is a wall panel.

17. An openable roof or openable wall as claimed in claim 5 wherein said third and forth sealing strips form a fluid tight seal against the inner longitudinal surface of said guide rail.

* * * * *